US006620570B2

(12) United States Patent
Kimoto et al.

(10) Patent No.: US 6,620,570 B2
(45) Date of Patent: Sep. 16, 2003

(54) ELECTROPHOTOGRAPHIC METHOD

(75) Inventors: Keizo Kimoto, Osaka (JP); Nobuyuki Kashiwagi, Osaka (JP); Hiroshi Shiomi, Osaka (JP)

(73) Assignee: Kyocera-Mita Corporation, Osaka (JP)

( * ) Notice: Subject to any disclaimer, the term of this patent is extended or adjusted under 35 U.S.C. 154(b) by 0 days.

(21) Appl. No.: 09/773,735

(22) Filed: Feb. 2, 2001

(65) Prior Publication Data

US 2001/0012595 A1 Aug. 9, 2001

(30) Foreign Application Priority Data

Feb. 21, 2000 (JP) ..... 2000-48870

(51) Int. Cl.[7] ..... G03G 13/08

(52) U.S. Cl. ..... 430/125; 430/69; 430/120; 399/350

(58) Field of Search ..... 430/69, 125, 50, 430/120; 399/350

(56) References Cited

U.S. PATENT DOCUMENTS 4,482,240 A * 11/1984 Kuge et al. ..... 399/350
5,166,023 A * 11/1992 Harada et al. ..... 430/69
5,229,821 A * 7/1993 Fujii ..... 399/350
5,532,101 A * 7/1996 Nozawa et al. ..... 430/125
6,070,032 A * 5/2000 Rokutanda et al. ..... 399/128

* cited by examiner

*Primary Examiner*—Christopher Rodee
(74) *Attorney, Agent, or Firm*—Sherman & Shalloway

(57) ABSTRACT

An electrophotographic method which uses a single-layer organic photosensitive material drum having a single organic photosensitive layer of a thickness of not smaller than 25 $\mu$m formed on an electrically conducting blank tube with a surface roughness Ra of not larger than 0.6 $\mu$m and rotates the photosensitive material drum at a peripheral speed of not smaller than 400 mm/sec, in order to execute an image-forming processing that includes electric charging, exposure to image-bearing light, developing, transfer, cleaning by a blade and removal of electric charge. Though the photosensitive material drum rotates at a high speed and a large frictional force is exerted on the cleaning blade, damage to the blade is effectively suppressed, and image is stably formed for extended periods of time without permitting the cleaning to become defective.

5 Claims, 2 Drawing Sheets

Method of seeking Ra

ELECTROPHOTOGRAPHIC METHOD

BACKGROUND OF THE INVENTION

1. Field of the Invention

The present invention relates to an electrophotographic method used for the image-forming apparatuses such as copiers, laser printers and plain paper facsimiles. More specifically, the invention relates to an electrophotographic method capable of executing an image-forming processing at a high speed.

2. Description of the Prior Art

In an image-forming apparatus utilizing an electrophotographic method as represented by a copier, a rotary photosensitive material drum is subjected to an image-forming processing which includes main electric charging, exposure to image-bearing light, developing, transfer, cleaning and removal of electric charge, in order to form an image.

A variety types of drum-like photosensitive materials have been used for the image-forming process based on the electrophotographic method. In recent years, in particular, there has been widely used an organic photosensitive material having an organic photosensitive layer formed on an electrically conducting blank tube. That is, the organic photosensitive material has a great advantage in that an organic photosensitive layer can be easily formed by a coating method at a decreased cost. Many organic photosensitive materials can be used for forming the organic photosensitive layer. By using a less harmful compound, the user is allowed to dispose of the photosensitive material when it is out of service life, offering a so-called maintenance-free advantage.

The above organic photosensitive materials can be grouped into single-layer organic photosensitive materials in which a photosensitive layer is a single layer containing an electric charge-generating agent and an electric charge-transporting agent, and function-separated laminated organic photosensitive materials in which the photosensitive layer includes an electric charge-generating layer containing an electric charge-generating agent and an electric charge-transporting layer containing an electric charge-transporting agent.

In modern high-speed digital image-forming apparatuses employing the above image-forming process that works at high speeds in a digital manner, however, various problems are occurring being caused by a high-speed rotation of the photosensitive material drum and due to the use of a semiconductor laser as a source of light for exposure to image-bearing light.

For example, when the function-separated laminated organic photosensitive material is exposed to image-bearing light by using a semiconductor laser as a source of light, interference fringes (Moire fringes) easily occur being affected by the surface of the electrically conducting blank tube which is the photosensitive layer-forming surface. In order to prevent the occurrence of interference fringes, a method has been known to set the surface roughness of the electrically conducting blank tube to lie within a predetermined range leaving, however, a problem that results from the high-speed rotation of the photosensitive material drum. That is, in the image-forming process, a cleaning blade is brought into pressed contact with the surface of the photosensitive material drum in order to remove the toner remaining on the surface of the photosensitive material drum. With the cleaning blade being brought into pressed contact with the surface of the photosensitive material drum, however, the electric charge-transporting layer on the surface of the photosensitive material drum is worn out to deteriorate the image properties to a conspicuous degree.

In the single-layer organic photosensitive material, on the other hand, light in the step of exposure to light is almost all absorbed by the surface of the photosensitive layer or near the surface thereof, and the interference fringes develop very little and the wear of the photosensitive layer is not much of a problem. That is, in the single-layer organic photosensitive material, the thickness of the photosensitive layer is considerably larger than that of the electric charge-transporting layer in the function-separated laminated photosensitive material. Therefore, wear of the photosensitive layer does not much affect the image properties. Thus, the single-layer organic photosensitive material is suited for the digital image-forming process of a high speed. Even by using the above organic photosensitive material, however, limitation is imposed on the processing speed for favorably forming images for extended periods of time. For example, when the image-forming process is conducted by rotating the photosensitive material drum at a peripheral speed of not smaller than 400 mm/sec, the photosensitive material drum is quickly accelerated up to a predetermined peripheral speed at the start of image formation, and a strong static frictional force acts on the tip of the cleaning blade that comes in contact with the surface of the photosensitive layer. Even in a steady state where the photosensitive material drum is rotating at a constant peripheral speed, a strong centrifugal force acts due to a high rotational speed, and a large dynamic frictional force acts on the tip of the cleaning blade. As a result, the tip of the blade is burred (the blade edge is finely cut and is burred) and, in an extreme case, the tip of the blade is turned up, causing the cleaning to become defective and making it difficult to favorably form the images within short periods of time.

Thus, no means has yet been proposed for avoiding defective cleaning of when the image-forming process is conducted at a high speed.

SUMMARY OF THE INVENTION

It is therefore an object of the present invention to provide an electrophotographic method which is capable of effectively preventing the defective cleaning at the time when an image-forming process is conducted by using a single-layer organic photosensitive material drum and by rotating the photosensitive material drum at a peripheral speed of not smaller than 400 mm/sec.

Another object of the present invention is to provide an electrophotographic method capable of favorably forming images without interference fringes even when a digital image-forming process is executed at a high speed by effecting the exposure to image-bearing light by using a semiconductor laser as a source of light.

According to the present invention, there is provided an electrophotographic method for forming image by subjecting a rotary photosensitive material drum to an image-forming process which includes main electric charging, exposure to image-bearing light, developing, transfer, cleaning and removal of electric charge, wherein:

said image-forming process is conducted by rotating the photosensitive material drum at a speed of not lower than a peripheral speed of 400 mm/sec;

said photosensitive material drum is a single-layer organic photosensitive material drum having a single organic photosensitive layer of a thickness of not smaller than 25 μm formed on an electrically conducting blank tube having a surface roughness Ra as defined in JIS-B-0601) of not larger than 0.6 μm; and the cleaning is effected by using a cleaning blade that is brought into pressed contact with the surface of the photosensitive material drum.

JIS-B-0601 describes a surface roughness Ra determined by the following Formula (I)

$$Ra=1/L\int_0^L|f(x)|dx \qquad \text{Formula (I)}$$

In particular, an arithmetic average roughness $(Ra)_L$ is taken along a standard length (L) obtained at random from a surface to be measured. The standard length is then taken along a roughness curve well known to those of ordinary skill in the art and as shown in FIG. 3. The length is given in the direction of the removed portion and an Y-axis established in the direction of lengthwise magnification, wherein the roughness curve is expressed as y=f(x).

In the present invention, a distinguished feature resides in the image-forming process by using the single-layer organic photosensitive material drum having a single organic photosensitive layer of a thickness of not smaller than 25 μm formed on the electrically conducting blank tube of a smooth surface with the surface roughness Ra of not larger than 0.6 μm and by rotating the photosensitive material drum at a peripheral speed of not lower than 400 mm/sec. Use of the single-layer organic photosensitive material drum effectively suppresses the formation of burrs and turn-up of the cleaning blade even when the high-speed image-forming process is conducted by rotating the photosensitive material drum at a peripheral speed of not lower than 400 mm/sec, and makes it possible to favorably form images for extended periods of time without permitting the cleaning to become defective.

Table 1 below shows the condition of the cleaning blade of when the image-forming process is executed for consecutively obtaining 100,000 pieces of copies by using a single-layer organic photosensitive material drum having a single photosensitive layer of a thickness of 20 μm formed on the surface of an electrically conducting blank tube (made of aluminum) having a surface roughness Ra of 1.3 μm while varying the rotational speed (peripheral speed) of the drum. The single-layer organic photosensitive material drum used here is employed by the conventional image-forming apparatus, and exposure to image-bearing light is conducted by using a semiconductor laser as a source of light.

TABLE 1

| Drum peripheral speed (mm/sec) | Condition of the blade |
|---|---|
| 100 | good |
| 150 | good |
| 200 | good |
| 400 | slightly burred after 2000 copies, but image was not affected |
| 500 | burred after 5000 copies, image was defective |
| 1000 | burred after 150 copies, image was defective |
| 1500 | blade turned up after 100 copies, image was defective |

As will be understood from Table 1 above, when there is used a single-layer organic photosensitive material drum having a surface roughness of the electrically conductive blank tube and having a thickness of the photosensitive layer lying outside the ranges of the present invention, damage to the cleaning blade becomes conspicuous as the rotational speed of the photosensitive material drum increases. In particular, damage to the blade becomes more conspicuous as the peripheral speed of the photosensitive material drum exceeds 400 mm/sec, and the image becomes defective within short periods of time due to defective cleaning.

On the other hand, when there is used a single-layer organic photosensitive material drum having a surface roughness Ra of the electrically conducting blank tube of not larger than 0.6 μm and a thickness of the photosensitive layer of not smaller than 25 μm, the image-forming process can be stably conducted for extended periods of time by rotating the photosensitive material drum at a peripheral speed of not lower than 400 mm/sec without damaging the cleaning blade and without causing the image to become defective that results from the defective cleaning.

It has been taught in, for example, FIG. 3 of Japanese Unexamined Patent Publication (Kokai) No. 305044/1996 that the surface roughness of the electrically conducting blank tube is reflected on the surface of the organic photosensitive layer formed on the surface of the blank tube, and the surface of the organic photosensitive layer can be made smooth by decreasing the surface roughness of the blank tube. Upon setting the surface roughness of the electrically conducting blank tube to be smaller than a predetermined value, therefore, it can be expected to prevent damage to the cleaning blade caused by friction by the photosensitive layer. Unexpectedly, however, it was learned that simply setting the surface roughness of the electrically conducting blank tube to be smaller than a predetermined value to make the surface of the photosensitive layer smooth, is not enough for preventing damage to the cleaning blade when the image is formed at high speeds. That is, the surface state of the electrically conducting blank tube is more reflected on the surface of the photosensitive layer when the thickness of the photosensitive layer is small. Therefore, if damage to the cleaning blade could be prevented by making the surface of the photosensitive layer smooth, then, it can be expected that damage to the blade can be prevented by setting the surface roughness of the electrically conducting tube to be smaller than a predetermined value and decreasing the thickness of the photosensitive layer. When the surface roughness Ra of the electrically conductive blank tube is set to be 0.25 μm like in Example 1 and the thickness of the photosensitive layer to be 20 μm which is smaller than that of Example 1, however, the cleaning blade is damaged within short periods of time at a drum peripheral speed of 400 mm/sec as demonstrated by Comparative Example 5 appearing later. That is, the blade edge is burred after the image-forming cycle of 6000 copies, and the image becomes defective after 7500 copies due to defective cleaning.

According to the present invention in which the surface roughness Ra of the electrically conductive blank tube is set to be smaller than the above-mentioned predetermined value and the thickness of the photosensitive layer is set to be not smaller than 25 μm, however, the cleaning blade is not damaged in the high-speed image-forming cycles, and defective cleaning and defective image are effectively avoided (in Example 1 appearing later, for example, the cleaning blade is not damaged and defective cleaning does not occur even when the image-forming cycle is conducted until 100,000 copies are obtained at a drum peripheral speed of 1000 mm/sec.). It is quite an unexpected event that the cleaning blade is not damaged by friction upon setting the thickness of the photosensitive layer to a large value so will not to reflect the surface roughness of the blank tube while setting the surface roughness Ra of the electrically conducting blank tube to be smaller than a predetermined value. It is presumed that in a high-speed image-forming cycle with a drum peripheral speed of 400 mm/sec, the frictional force exerted on the cleaning blade is so large that making the surface of the photosensitive layer smooth is not enough for preventing damage to the blade, but damage to the blade is effectively prevented by increasing the thickness of the photosensitive layer to some extent so that the photosensitive layer exhibits a cushioning function.

Simply making the surface of the photosensitive layer smooth is not enough for preventing damage to the blade as will be obvious from the experimental results of Comparative Example 6 appearing later. That is, Comparative Example 6 deals with the execution of image-forming cycles by using an organic photosensitive material drum (drum of Comparative Example 1) having a photosensitive layer of a thickness of 25 $\mu$m formed on an electrically conducting blank tube with a surface roughness Ra of 0.80 $\mu$m and by adjusting the surface roughness Ra of the photosensitive layer to be not larger than 0.5 $\mu$m by using a polishing agent. If damage to the blade could be prevented by making the surface of the photosensitive layer smooth, then, damage to the blade could be prevented in Comparative Example 6, too. In Comparative Example 6, however, the cleaning blade is damaged after the image-forming cycles of 20,000 copies at the drum peripheral speed of 400 mm/sec, and the image becomes defective after 35,000 copies due to defective cleaning. From the above, it is believed that simply making the surface of the photosensitive layer smooth is not capable of effectively preventing damage to the blade and that setting the surface roughness Ra of the electrically conducting blank tube to be not larger than 0.6 $\mu$m exhibits action in addition to making the surface of the photosensitive layer smooth (the present inventors presume that adhesion is improved between the photosensitive layer and the surface of the blank tube).

According to the present invention as described above, the photosensitive layer is formed on the electrically conductive blank tube having a surface roughness Ra of not larger than 0.6 $\mu$m to make the surface of the photosensitive layer flat to a suitable degree and, at the same time, to enhance adhesion between the photosensitive layer and the electrically conducting blank tube. Besides, the thickness of the photosensitive layer is selected to be not smaller than 25 $\mu$m so that the photosensitive layer works as a cushioning layer. This effectively prevents damage to the cleaning blade caused by friction in a high-speed image-forming cycle at a drum peripheral speed of 400 mm/sec, effectively suppresses the occurrence of defective cleaning and defective image caused by the damaged blade and, hence, makes it possible to stably form images over extended periods of time.

Here, in the present invention, when a function-separated laminated photosensitive layer is formed on the electrically conducting blank tube instead of forming the single-layer organic photosensitive layer, there develop interference fringes when the photosensitive layer is exposed to image-bearing light particularly when a semiconductor laser is used as a source of light.

DETAILED DESCRIPTION OF THE INVENTION

Figure 1:
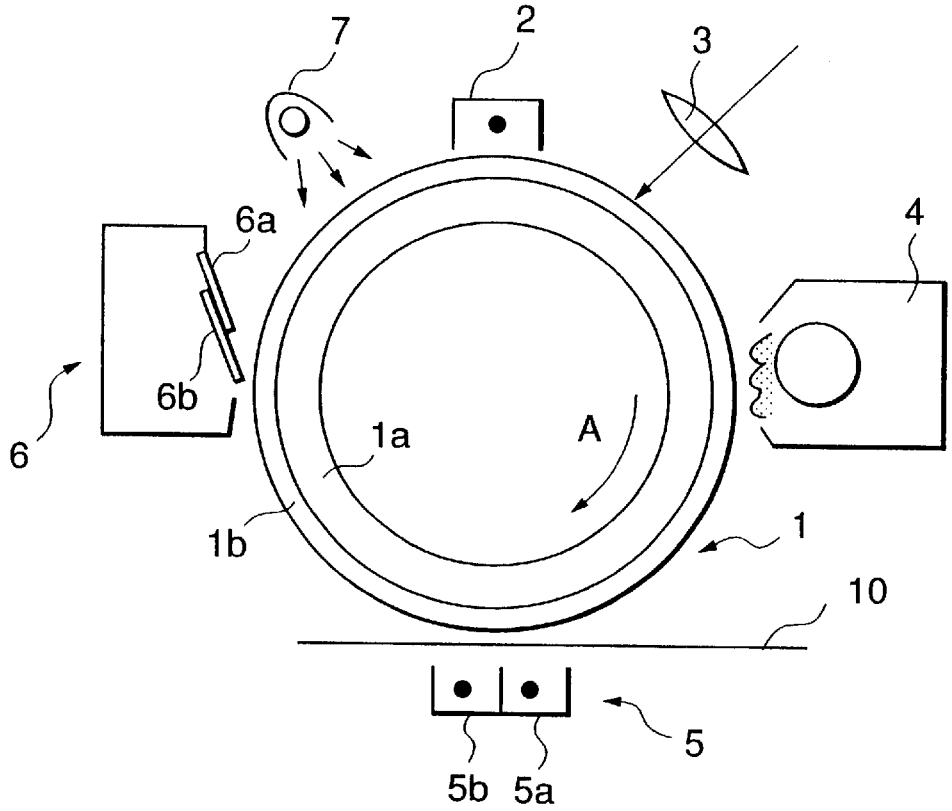
FIG. 1 is a view schematically illustrating the structure of an image-forming apparatus for favorably putting an electrophotographic method of the present invention into practice.

Referring to FIG. 1, an organic photosensitive material drum which is generally designated at 1 is surrounded by a main charger 2, an optical system 3, a developing device 4, a transfer device 5, a cleaning device 6 and a source of light 7 for removing electric charge in this order along a direction in which the drum 1 rotates as indicated by an arrow A in FIG. 1.

The organic photosensitive material drum 1 has a single-layer organic photosensitive layer 1*b* formed on an electrically conducting blank tube 1*a*.

The electrically conductive blank tube 1*a* may be made of any electrically conducting material but is, generally, made of aluminum. In order to improve mechanical strength and corrosion resistance, there may be further used an aluminum alloy containing magnesium (Mg), silicon (Si), etc. in suitable amounts. In order to improve breakdown voltage properties, further, an Alumite layer may, as required, be formed on the surface of the electrically conducting blank tube 1*a* by the anodic oxidation treatment in an acidic bath such as of chromic acid, sulfuric acid, oxalic acid, boric acid or sulfamic acid and by the aperture-sealing treatment.

In the present invention, the surface of the electrically conducting blank tube 1*a* is adjusted to possess a surface roughness Ra of not larger than 0.6 $\mu$m, preferably, not larger than 0.45 $\mu$m and, most preferably, from 0.1 to 0.45 $\mu$m by being polished by using a polishing agent or the like. When the surface roughness Ra is larger than the above range, damage to the cleaning blade is not effectively prevented in the image-forming process conducted at high speeds, and the image tends to become defective due to defective cleaning. When the surface roughness Ra is smaller than 0.1 $\mu$m, the binding property between the organic photosensitive layer 1*b* and the blank tube 1*a* tends to decrease.

The single organic photosensitive layer 1*b* on the electrically conducting blank tube 1*a* comprises a binder resin in which an electric charge-generating agent and an electric charge-transporting agent are homogeneously dispersed.

As the electric charge-generating agent, there can be used bisazo pigment, trisazo pigment, phthalocyanine pigment, perylene pigment, polycyclic quinone pigment, squarilium pigment, xanthene pigment, quinacridone pigment and indigo pigment. The electric charge-generating agent is used in an amount of, usually, from 0.1 to 50 parts by weight and, particularly, from 0.5 to 30 parts by weight per 100 parts by weight of the binder resin.

As the electric charge-transporting agent, there can be used positive hole-transporting substances, such as benzidine compound, phenylenediamine compound, hydrazone compound, pyrazoline compound, stilbene compound, oxadiazole compound, carbazole compound, enamine compound, and triphenylmethane compound, as well as electron-transporting substances, such as diphenoquinone compound, naphthoquinone compound, fluorenone compound and imine compound, depending upon the photosensitive and charging properties of the photosensitive material. The electric charge-transporting agent is used, usually, in an amount of from 20 to 300 parts by weight and, particularly, from 50 to 200 parts by weight per 100 parts by weight of the binder resin. It is further allowable to use the positive hole-transporting agent and the electron-transporting agent in combination.

As the binder resin, there can be used polycarbonate resins obtained from bisphenol A, bisphenol C or bisphenol Z, as well as polyester resin, acrylic resin, silicone resin and the like resin.

In the binder resin can be further dispersed, as required, known additives such as antioxidant, ultraviolet ray-absorbing agent, quencher or the like agent in addition to the above-mentioned electric charge-generating agent and the electric charge-transporting agent.

The organic photosensitive layer 1*b* is formed by a known method such as a so-called dipping method. For example, the above-mentioned various photosensitive layer-forming materials is homogeneously dissolved in an organic solvent such as tetrahydrofurane, toluene, dioxane or dichloromethane so as to have a suitable degree of viscosity to prepare a coating solution. Then, the electrically conducting blank tube 1*a* is immersed in the coating solution and is pulled up to prepare an organic photosensitive material drum having a single organic photosensitive layer 1*b*.

In the present invention, the organic photosensitive layer 1*b* is formed by, for example, adjusting the viscosity of the coating solution or adjusting the rate of pulling up the blank tube immersed in the coating solution so as to have a thickness of not smaller than 25 $\mu$m, desirably, not smaller than 30 $\mu$m and, most desirably, from 30 to 50 $\mu$m (for example, the photosensitive layer is formed having an increased thickness when the coating solution has a high viscosity and the photosensitive layer is formed having a decreased thickness when the coating solution has a low viscosity). When the thickness of the organic photosensitive layer 1*b* is smaller than the above range as described already, it is not possible to effectively prevent damage to the cleaning blade in the image-forming process conducted at high speeds. When the thickness of the organic photosensitive layer 1*b* exceeds 50 $\mu$m, further, the thickness tends to become fluctuated and the photosensitive material properties lose stability.

As required, further, the surface of the organic photosensitive layer 1*b* may be polished by using a polishing agent or a laser beam so as to possess the surface roughness Ra of not larger than 0.03 $\mu$m.

According to the present invention, the image-forming processing is conducted as described below while rotating the above-mentioned organic photosensitive material drum 1 at a drum peripheral speed of not lower than 400 mm/sec.

First, the surface of the photosensitive material drum 1 (surface of the organic photosensitive layer 1*b*) is uniformly and electrically charged into a predetermined polarity by the main charger 2. A corona charger is usually used as the main charger 2. It is, however, also allowable to effect the main charging by a contact charging method using an electrically conducting roller or the like.

Then, the surface of the photosensitive material drum 1 is exposed to image-bearing light through the optical system 3 to form an electrostatic latent image thereon. That is, the potential on the surface of the photosensitive layer 1*b* is attenuated in a portion irradiated with light reflected by the manuscript or with light according to an instruction from a computer, thereby to form an electrostatic latent image according to predetermined manuscript data. Here, the source of light may be a known one. In the case of a digital image-forming process, however, a semiconductor laser is used as a source of light.

The thus formed electrostatic latent image is developed by a developing agent filled in the known developer 4, and a toner image is formed on the surface of the photosensitive material drum 1. As the developing agent, there can be used a so-called two-component magnetic developing agent comprising a toner and a magnetic carrier (e.g., ferrite or iron powder), and a one-component developing agent comprising a magnetic toner. The toner in the developing agent is electrically charged by friction into a predetermined polarity. When, for example, a normal developing is effected as is normally employed by an analog image-forming cycle, the toner in the developing agent is electrically charged into a polarity opposite to the polarity of electric charge in the organic photosensitive layer, and a toner image is formed as the toner adheres onto the portion where the potential has not been attenuated (portion that has not been irradiated with light). When a reversal developing is effected as is usually employed by a digital image-forming cycle, a toner image is formed as the toner adheres onto the portion irradiated with light (portion where the potential has attenuated).

The toner image formed on the surface of the photosensitive material drum 1 is transferred, by a transfer device 5, onto a transfer sheet 10 such as paper conveyed onto the surface of the photosensitive material drum 1. The transfer device 5 shown in FIG. 1 includes a transfer charger 5*a* and a separator charger 5*b*. Due to the transfer charger 5*a*, the back surface of the transfer sheet 10 is corona-charged into a polarity opposite to that of the toner image, and the toner image on the drum 1 is transferred onto the surface of the transfer sheet 10. Then, due to the separator charger 5*b*, the back surface of the transfer sheet 5*b* is electrically charged with an alternating current. Therefore, the transfer sheet 10 is discharged without being wound on the surface of the drum 1. As the transfer device 5, there can be also used a transfer roller. In this case, a bias voltage of a polarity opposite to the toner image is applied to the transfer roller, and the toner image is transferred onto the surface of the transfer sheet 10.

The transfer sheet 10 onto which the toner image is transferred is introduced into a fixing device that is not shown in FIG. 1; i.e., the toner image is fixed onto the surface of the transfer sheet 10 by heat and pressure.

After the toner image has been transferred onto the transfer sheet 10, the toner remaining on the surface of the photosensitive material drum 1 is removed by the cleaning device 6.

The cleaning device 6 has a cleaning blade 6*b* held by a rigid holder 6*a*. Upon bringing the blade 6*b* into pressed contact with the surface of the photosensitive material drum 1, the toner remaining on the surface of the drum 1 is removed and recovered. From the standpoint of suppressing wear to the photosensitive layer 1*b* and exhibiting sufficient degree of cleaning action, it is desired that the cleaning blade 6*b* is made of a rubber, such as urethane rubber or silicone rubber having a hardness (JIS A) of, usually from 40 to 90°, and is brought into pressed contact with the surface of the photosensitive material drum 1 (surface of the photosensitive layer 1*b*) with a pressing force of 2 to 40 g/mm. When the pressing force is smaller than the above range, the cleaning becomes defective causing the toner to escape through and, besides, defective image such as dash mark tends to occur due to defective cleaning. When the pressing force is larger than the above range, on the other hand, the photosensitive layer 1*b* tends to be worn out conspicuously and, besides, a slide noise or so-called blade noise may generate.

Figure 2:
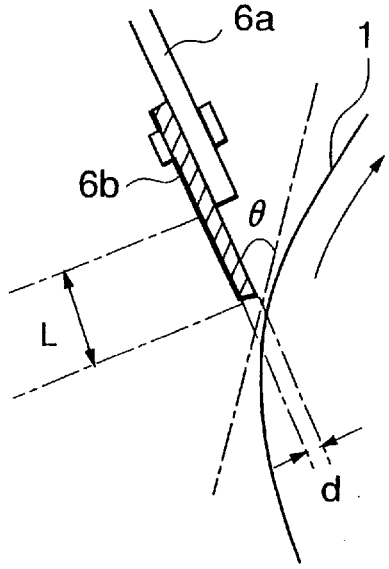
FIG. 2 is a view illustrating, on an enlarged scale, a tip (edge) of a cleaning blade employed by the image-forming apparatus of FIG. 1.
Figure 3:
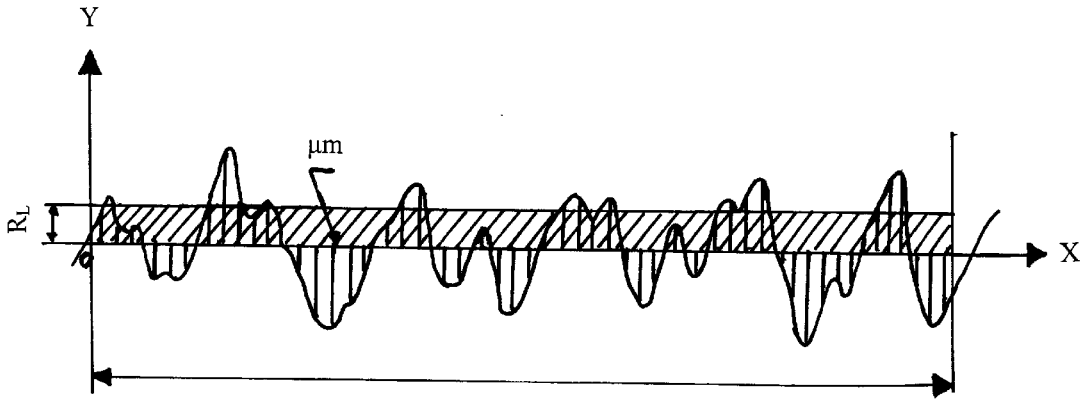
FIG. 3 is an example of a roughness curve used in determining an arithmetic average surface roughness Ra, wherein the Y-axis is taken along a direction of lengthwise magnification and the X-axis is taken along a direction of a standard length (L) from a surface to be measured.

Referring to FIG. 2 illustrating, on an enlarged scale, the edge portion of the cleaning blade 6*b*, it is desired that the blade 6*b* has a thickness d of from 1 to 5 mm, the tip of the blade 6*b* protrudes beyond the holder 6*a* by a length L of from 5 to 20 mm, and that the contacting angle θ of the blade 6*b* is from 5 to 40° from the standpoint of obtaining a sufficiently large cleaning action and effectively suppressing damage such as burr or turn-up of the blade 6*b* and suppressing wear of the photosensitive layer 1*b*.

After cleaning, the electric charge of the surface of the photosensitive material drum 1 is removed with the source of light 7 and the next forming image process is performed. The source of light 7 may be provided between the transfer device 5 and the cleaning device 6.

According to the electrophotographic method of the present invention which executes the image-forming process at a high speed by rotating the organic photosensitive material drum 1 at a peripheral speed of not lower than 400 mm/sec, the organic photosensitive material drum 1 has the above-mentioned structure making it possible to stably execute the image-forming process over extended periods of time effectively suppressing damage to the cleaning blade 6*b* caused by friction and, hence, without permitting the image to be deteriorated by defective cleaning. Even when the organic photosensitive material drum 1 is rotated at a peripheral speed of, for example, not lower than 1000 mm/sec, damage to the cleaning blade 6*b* can be effectively avoided.

In the image-forming process shown in FIG. 1, the developer is disposed in a number of only one. The invention, however, can also be applied to a full-color image-forming process by disposing plural developers to surround the photosensitive material drum 1. The invention can be further applied even to a so-called tandem full-color image-forming process in which plural image-forming units including the photosensitive material drum and the peripheral equipment are arranged side by side.

The electrophotoraphic method of the invention can be particularly effectively applied to a digital image-forming process that uses a semiconductor laser as a source of light for exposure to image-bearing light.

EXAMPLES

Example 1

Charge-generating agent: metal-free phthalocyanine, 1.5 parts by weight,

Positive hole-transporting agent: 3,3'-dimethyl-N,N'-bis (4-methyl)benzidine, 60 parts by weight, Electron-transporting agent: 3,5-dimethyl-3',5'-di-tert-butyl-4,4'-diphenoquinone, 30 parts by weight, Binder resin: bisphenol Z-type polycarbonate having a molecular weight of 50,000, 100 parts by weight, were homogeneously dispersed in a tetrahydrofuran to prepare a coating solution having a viscosity of 250 cps (25° C.).

An aluminum blank tube having a surface roughness Ra of 0.25 μm was dipped in the coating solution and was pulled up at a rate of 5 mm/sec to prepare a single-layer organic photosensitive material drum having a photosensitive layer of a thickness of 25 μm. The photosensitive layer on the photosensitive material drum possessed a surface roughness Ra of 0.05 μm.

The photosensitive material drum was mounted on a modified machine which was a digital copier KM-6230 manufactured by Kyocera-Mita Co., and the printing was effected at a processing speed (peripheral drum speed) of 1000 mm/sec by using the following cleaning blade.

Cleaning blade:

Material: urethane rubber having a hardness of 62°

Thickness d: 1.8 mm

Pressing force: 8 g/mm

Contact angle: 18.5°

Length L of protrusion from the holder: 10 mm 100,000 copies were printed without accompanied by defective cleaning. The edge of the blade was normal without being burred.

Reference Example 1

100,000 copies were printed in quite the same manner as in Example 1 but setting the processing speed (peripheral drum speed) to be 300 mm/sec without accompanied by defective cleaning. The edge of the blade was normal without being burred.

Example 2

100,000 copies were printed in quite the same manner as in Example 1 but setting the processing speed (peripheral drum speed) to be 400 mm/sec without accompanied by defective cleaning. The edge of the blade was normal without being burred.

Example 3

100,000 copies were printed in quite the same manner as in Example 1 but setting the processing speed (peripheral drum speed) to be 1250 mm/sec without accompanied by defective cleaning. The edge of the blade was normal without being burred.

Example 4

100,000 copies were printed in quite the same manner as in Example 1 but setting the processing speed (peripheral drum speed) to be 1500 mm/sec without accompanied by defective cleaning. The edge of the blade was normal without being burred.

Example 5

An organic photosensitive material drum was prepared in the same manner as in Example 1 but using a coating solution having a viscosity of 300 cps and effecting the dip-coating at a pull-up rate of 5 mm/sec. The photosensitive layer of the photosensitive material drum possessed a surface roughness Ra of 0.034 μm.

100,000 copies were printed in quite the same manner as in Example 1 but using the above organic photosensitive material drum without accompanied by defective cleaning. The edge of the blade was normal without being burred.

Example 6

An organic photosensitive material drum was prepared in the same manner as in Example 1 but using an aluminum blank tube having a surface roughness Ra of 0.45 μm. The photosensitive layer of the photosensitive material drum possessed a surface roughness Ra of 0.08 μm.

100,000 copies were printed in quite the same manner as in Example 1 but using the above organic photosensitive material drum without accompanied by defective cleaning. The edge of the blade was normal without being burred.

Example 7

An organic photosensitive material drum was prepared in the same manner as in Example 1 but using an aluminum blank tube having a surface roughness Ra of 0.60 μm. The photosensitive layer of the photosensitive material drum possessed a surface roughness Ra of 0.11 μm.

100,000 copies were printed in quite the same manner as in Example 1 but using the above organic photosensitive material drum without accompanied by defective cleaning. The edge of the blade was normal without being burred.

Example 8

An organic photosensitive material drum having a photosensitive layer of a thickness of 30 μm was prepared in the same manner as in Example 2 but using an aluminum blank tube having a surface roughness Ra of 0.45 μm. The photosensitive layer of the photosensitive material drum possessed a surface roughness Ra of 0.06 μm.

100,000 copies were printed in quite the same manner as in Example 1 but using the above organic photosensitive material drum without accompanied by defective cleaning. The edge of the blade was normal without being burred.

Example 9

An organic photosensitive material drum was prepared in the same manner as in Example 1 but using an aluminum blank tube having a surface roughness Ra of 0.45 μm and having a photosensitive layer of a thickness of 40 μm formed thereon. The photosensitive layer of the photosensitive material drum possessed a surface roughness Ra of 0.04 μm.

100,000 copies were printed in quite the same manner as in Example 1 but using the above organic photosensitive material drum without accompanied by defective cleaning. The edge of the blade was normal without being burred.

Example 10

An organic photosensitive material drum was prepared in the same manner as in Example 1 but using an aluminum blank tube having a surface roughness Ra of 0.60 μm and having a photosensitive layer of a thickness of 30 μm formed thereon. The photosensitive layer of the photosensitive material drum possessed a surface roughness Ra of 0.07 μm.

100,000 copies were printed in quite the same manner as in Example 1 but using the above organic photosensitive material drum without accompanied by defective cleaning. The edge of the blade was normal without being burred.

Example 11

An organic photosensitive material drum was prepared in the same manner as in Example 1 but using an aluminum blank tube having a surface roughness Ra of 0.60 μm and having a photosensitive layer of a thickness of 40 μm formed thereon. The photosensitive layer of the photosensitive material drum possessed a surface roughness Ra of 0.05 μm.

100,000 copies were printed in quite the same manner as in Example 1 but using the above organic photosensitive material drum without accompanied by defective cleaning. The edge of the blade was normal without being burred.

Comparative Example 1

An organic photosensitive material drum was prepared in the same manner as in Example 1 but using an aluminum blank tube having a surface roughness Ra of 0.80 μm and having a photosensitive layer formed thereon. The photosensitive layer of the photosensitive material drum possessed a surface roughness Ra of 0.145 μm.

Copies were printed in quite the same manner as in Example 1 but using the above organic photosensitive material drum and setting the peripheral drum speed to be 500 mm/sec. As a result, the edge of the blade was burred after 5,000 copies were printed, and the image became defective due to defective cleaning after 7,000 copies were printed.

Comparative Example 2

An organic photosensitive material drum was prepared in the same manner as in Example 1 but using an aluminum blank tube having a surface roughness Ra of 1.0 μm and having a photosensitive layer formed thereon. The photosensitive layer of the photosensitive material drum possessed a surface roughness Ra of 0.180 μm.

Copies were printed in quite the same manner as in Example 1 but using the above organic photosensitive material drum and setting the peripheral drum speed to be 500 mm/sec. As a result, the edge of the blade was burred after 3,000 copies were printed, and the image became defective due to defective cleaning after 5,000 copies were printed.

Comparative Example 3

Copies were printed in quite the same manner as in Comparative Example 1 but setting the peripheral drum speed to be 1000 mm/sec. As a result, the edge of the blade was burred after 500 copies were printed, and the image became defective due to defective cleaning after 650 copies were printed.

Table 2 shows the evaluated results of Examples 1 to 11, and Comparative Examples 1 to 3. In the Column of evaluated results of Table 2, "good" means that the blade was not damaged (was not burred) and the cleaning did not become defective even after 100,000 copies were printed.

TABLE 2

| | Thickness of photosensitive layer (μm) | Surface roughness of blank tube (μm) | Peripheral drum speed (mm/sec) | Results of evaluation |
|---|---|---|---|---|
| Example 1 | 25 | 0.25 | 1000 | good |
| Ref. Ex. 1 | 25 | 0.25 | 300 | good |
| Example 2 | 25 | 0.25 | 400 | good |
| Example 3 | 25 | 0.25 | 1250 | good |
| Example 4 | 25 | 0.25 | 1500 | good |
| Example 5 | 30 | 0.25 | 1000 | good |
| Example 6 | 25 | 0.45 | 1000 | good |
| Example 7 | 25 | 0.60 | 1000 | good |
| Example 8 | 30 | 0.45 | 1000 | good |
| Example 9 | 40 | 0.45 | 1000 | good |
| Example 10 | 30 | 0.60 | 1000 | good |
| Example 11 | 40 | 0.60 | 1000 | good |
| Comp. Ex. 1 | 25 | 0.80 | 500 | burred after 5,000 copies, defective cleaning after 7,000 copies |
| Comp. Ex. 2 | 25 | 1.00 | 500 | burred after 3,000 copies, defective cleaning after 5,000 copies |
| Comp. Ex. 3 | 25 | 0.80 | 1000 | burred after 500 copies, defective cleaning after 650 copies |

Comparative Example 4

One part by weight of a metal-free phthalocyanine (electric charge-generating agent) and one part by weight of a polyvinyl butyral (binder resin) were homogeneously dispersed in a tetrahydrofuran to prepare a coating solution. By using this coating solution, an electric charge-generating layer was formed maintaining a thickness of 0.5 μm on an aluminum blank tube having a surface roughness Ra of 0.25 μm.

80 Parts by weight of a 3,3'-dimethyl-N,N'-bis(4-methyl) benzidine (electric charge-transporting agent) and 100 parts by weight of a bisphenol z-type polycarbonate (binder resin), were homogeneously dispersed in a tetrahydrofurane to prepare a coating solution. By using this coating solution, an electric charge-transport layer was formed maintaining a thickness of 25 μm on the electric charge-generating layer thereby to prepare a function-separated laminated photosensitive material drum.

By using the above photosensitive material drum, copies were printed in quite the same manner as in Example 1. As a result, interference fringes developed, and favorable image was not obtained at all.

Comparative Example 5

A single-layer organic photosensitive material drum was prepared in the same manner as in Example 1 but forming the photosensitive layer maintaining a thickness of 20 μm. The photosensitive layer possessed a surface roughness Ra of 0.075 μm.

Copies were printed in quite the same manner as in Example 1 but using the above photosensitive material drum and setting the peripheral drum speed to be 400 mm/sec. As a result, the edge of the blade was burred after 6,000 copies were printed, and the image became defective due to defective cleaning after 7,500 copies were printed.

Comparative Example 6

The organic photosensitive material drum prepared in Comparative Example 1 was polished with a laser beam, so that the photosensitive layer possessed a surface roughness Ra of 0.05 μm.

Copies were printed in quite the same manner as in Example 1 but using the above photosensitive material drum and setting the peripheral drum speed to be 400 mm/sec. As a result, the edge of the blade was burred after 20,000 copies were printed, and the image became defective due to defective cleaning after 35,000 copies were printed.

What is claimed is:

1. An electrophotographic method for forming image by subjecting a rotary photosensitive material drum to an image-forming process which includes main electric charging, exposure to image-bearing light, developing, transfer, cleaning and removal of electric charge, wherein:

said image-forming process is conducted by rotating the photosensitive material drum at a speed of not lower than a peripheral speed of 400 mm/sec;

said photosensitive material drum is a single-layer organic photosensitive material drum having a single organic photosensitive layer of thickness of not smaller than 25 μm formed on an electrical conducting blank tube having a surface roughness Ra defined by JIS-B-0601 of not larger than 0.6 μm; and the cleaning is effected by using a cleaning blade that is brought into pressed contact with the surface of the photosensitive material drum.

2. An electrophotographic method according to claim 1, wherein said cleaning blade is brought into pressed contact with the surface of the photosensitive material drum with a pressing force of 2 to 40 g/mm.

3. An electrophotographic method according to claim 2, wherein said cleaning blade is a rubber blade having a thickness of from 1 to 5 mm.

4. An electrophotographic method according to claim 2, wherein said cleaning blade is supported by a rigid holder, and a tip of the cleaning blade brought into pressed contact with the surface of the photosensitive material drum protrudes beyond said holder by a length of from 5 to 20 mm.

5. An electrophotographic method according to claim 1, wherein the exposure to image-bearing light is carried out by using a semiconductor laser as a source of light.

* * * * *